US007886818B1

(12) United States Patent
O'Connor et al.

(10) Patent No.: US 7,886,818 B1
(45) Date of Patent: Feb. 15, 2011

(54) EXPANDABLE PACKER SYSTEM

(75) Inventors: Keven O'Connor, Houston, TX (US); Mark K. Adam, Houston, TX (US); Jeffrey C. Williams, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/925,319

(22) Filed: Oct. 19, 2010

Related U.S. Application Data

(60) Continuation of application No. 12/592,491, filed on Nov. 25, 2009, now Pat. No. 7,845,402, which is a division of application No. 12/156,408, filed on May 30, 2008, now Pat. No. 7,703,542.

(60) Provisional application No. 60/933,183, filed on Jun. 5, 2007.

(51) Int. Cl.
*E21B 33/12* (2006.01)

(52) U.S. Cl. ..... 166/179; 166/191; 166/387; 166/380; 166/207; 166/242.1

(58) Field of Classification Search ..... 166/179, 166/191, 207, 242.1, 380, 387
See application file for complete search history.

(56) References Cited

U.S. PATENT DOCUMENTS

| | | | | |
|---|---|---|---|---|
| 2,812,025 | A | 11/1957 | Teague et al. | |
| 2005/0023003 | A1 * | 2/2005 | Echols et al. | 166/384 |
| 2007/0125532 | A1 | 6/2007 | Murray et al. | |
| 2008/0149351 | A1 | 6/2008 | Marya et al. | |

* cited by examiner

*Primary Examiner*—Daniel P Stephenson
*Assistant Examiner*—Yong-Suk Ro
(74) *Attorney, Agent, or Firm*—Greenberg Traurig LLP; Anthony F. Matheny

(57) ABSTRACT

The expandable casing packing element systems for cased and open-hole wellbores include an expandable casing member having a sealing device comprising a sealing element disposed between at least two retainer rings. The retainer rings have flat cross-sections and the sealing element is forced radially outward by the expansion of the expandable casing against the two retainer rings such that the sealing element protrudes outwardly beyond the retainer rings and engages the wall of a wellbore in three locations. The retainer rings can also include flares that extend outwardly from the body of the expandable casing to which they are attached. As the expandable casing is expanded, the flares are forced inward to compress the sealing element which is then extruded radially outward through a gap between the two retainer rings to engage and seal off the wellbore.

6 Claims, 3 Drawing Sheets

EXPANDABLE PACKER SYSTEM

RELATED APPLICATION

This application is a continuation application of, and claims priority to, U.S. patent Ser. No. 12/592,491, filed Nov. 25, 2009, now U.S. Pat. No. 7,845,402, which is a divisional application of, and claims priority to, U.S. patent application Ser. No. 12/156,408 filed May 30, 2008, now U.S. Pat. No. 7,703,542, which claims the benefit of U.S. Provisional Patent Application Ser. No. 60/933,183, filed Jun. 5, 2007.

BACKGROUND

The invention is directed to expandable casing packing element systems for use in oil and gas wells and, in particular, expandable casing packing element systems having extrudable sealing elements for sealing open-hole wells.

Expandable casing having a sealing element such as a packer have been used to seal the annulus of open-hole wells. In operation, after the well is drilled into the earth formation, the expandable casing is run into the well. The expandable casing has disposed on it, or as part of the expandable casing string, a sealing device such as a packer. The packer is designed to divide the well by sealing against the well formation, thereby isolating a lower portion of the well from an upper portion of the well.

After the expandable casing is run into the desired location in the well, a cone or other device can be transported through the bore of the expandable casing. As the cone, such as a swage, travels downward, the expandable casing is expanded by the cone. The expansion of the expandable casing causes the sealing device to contact the formation and separate the open-hole well into at least two isolated regions, one above the sealing device and one below the sealing device.

The expandable casing and sealing devices disclosed herein include components that, to the inventors' knowledge, are novel and non-obvious from previous expandable casing and sealing devices.

SUMMARY OF INVENTION

Broadly, the expandable casing packing element systems disclosed herein include an expandable casing member having a sealing device comprising a sealing element disposed between at least two retainer rings. In one embodiment, both retainer rings have flat cross-sections and the sealing element is forced radially outward by the expansion of the expandable casing against the two retainer rings such that the sealing element protrudes outwardly beyond the retainer rings and engages the wall of the a wellbore in three locations. The wellbore may be an opened-hole wellbore or a cased wellbore. In another embodiment, both of the two retainer rings include flares that extend outwardly from the body of the expandable casing to which they are attached. As the expandable casing is expanded, the flares are forced inward to compress the sealing element which is then extruded radially outward through a gap between the two retainer rings to engage and seal off the wellbore.

Also disclosed is a method comprising the steps of: (a) running an expandable casing string having a packing element system attached thereto into a wellbore defined by an inner wall surface, the packing element system having a sealing element and at least two retainer rings, at one of the at least two retainer rings overlapping the sealing element; (b) applying a radial load to expand the expandable casing, causing the sealing element to be extruded outwardly by at least one of the at least two retainer rings applying an inward force to the sealing element; and (c) continuing to apply the radial load causing the sealing element to move radially outward into sealing engagement with the inner wall surface of the wellbore. In one particular embodiment, the wellbore is cased. In another specific embodiment, the wellbore is an opened-hole wellbore.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Figure 1:
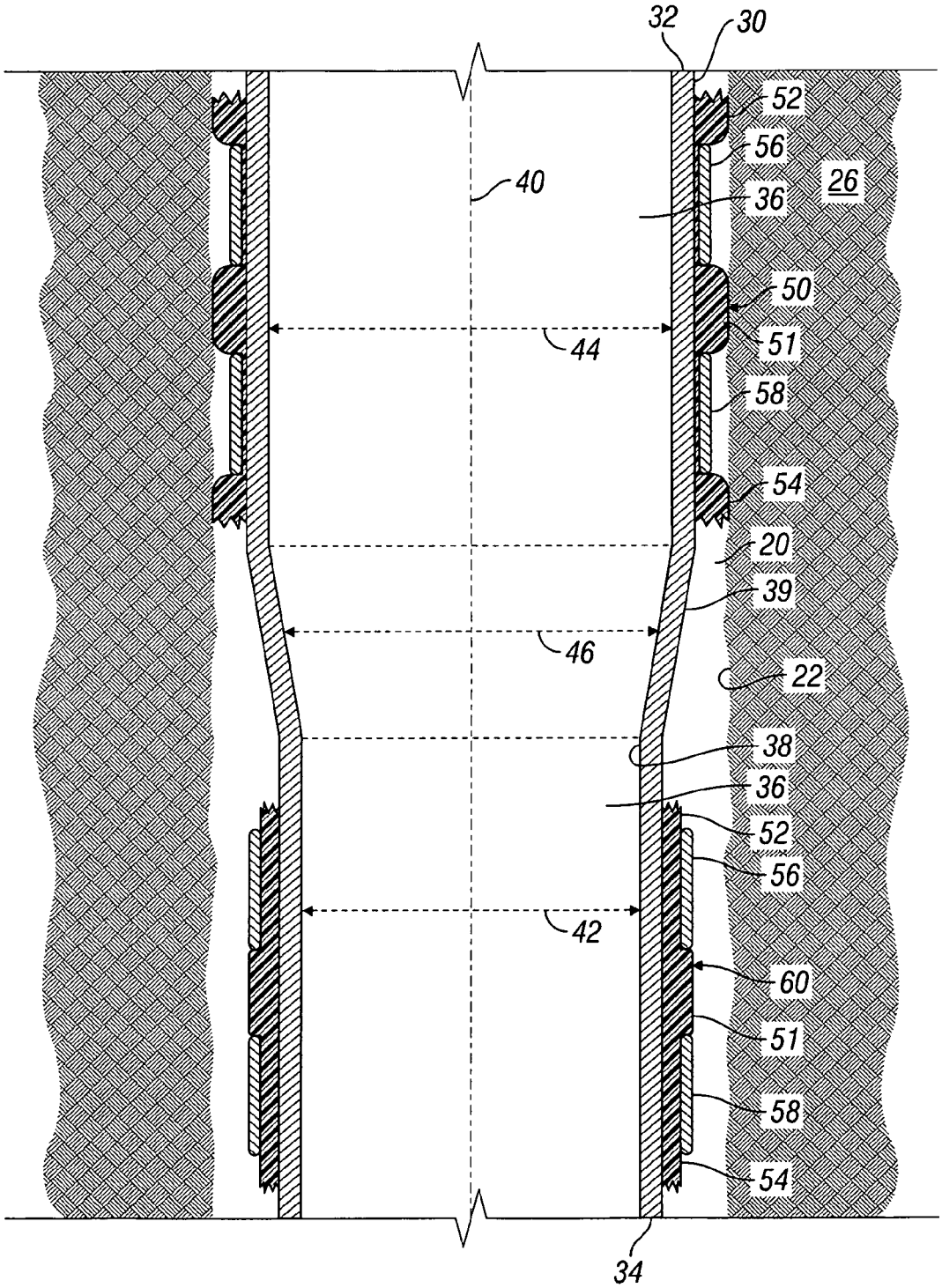
FIG. 1 is a cross-sectional view of one embodiment of an expandable casing having a sealing device, FIG. 1 showing the expandable casing as it is being expanded from its run-in position to its expanded or set position.

Referring now to FIG. 1, in one specific embodiment, expandable casing 30 is disposed within well 20 that has been drilled into formation 26. Well 20 is defined by well inner wall surface 22. Expandable casing 30 has upper end 32, lower end 34, bore 36 defined by inner wall surface 38, outer wall surface 39, and axis 40. Expandable casing 30 includes run-in diameter 42, set diameter 44, and transitional diameter 46. Run-in diameter 42 is less than set diameter 44 and transitional diameter 46 illustrates the location of a cone (not shown) or other device used to expand expandable casing 30 from the run-in diameter 42 to the set diameter 44. Although a cone is described as being used to expand expandable casing 30 from the run-in diameter 42 to the set diameter 44, it is to be understood that any device or method known to persons of ordinary skill in the art may be used to expand expandable casing 30.

As illustrated in FIG. 1, disposed on outer wall surface 39 of expandable casing 30 are upper sealing device 50 and lower sealing device 60. In this embodiment, upper sealing device 50 is identical to lower sealing device 60 except that upper sealing device 50 is shown in the set position and lower sealing device 60 is shown in the run-in position. It is to be understood, however, that expandable casing 30 may have only one sealing device 50, 60, or more than two sealing devices 50, 60. For convenience, both upper and lower sealing devices 50, 60 will be discussed in greater detail with reference to like numerals.

Sealing devices 50, 60 include annular deformable sealing elements 51 having upper ends 52 and lower ends 54, upper retainer ring 56, and lower retainer ring 58. Sealing element 51 is a deformable element formed from an deformable material so that radial outward movement of sealing element 51 away from axis 40 and into upper and lower retainer rings 56, 58 causes sealing element 51 to extrude into sealing contact with inner wall surface 22 of well 20. Suitable materials for forming sealing element 51 include, but are not limited to, elastomers, rubbers, polymers, or thermoplastics.

Additionally, sealing element 51 may have any shape desired or necessary to provide the requisite compression, deformation, or "extrusion" to form the seal with inner wall surface 22 of well 20. As shown in FIG. 1, in this specific embodiment, sealing element 51 is formed in the shape of a sleeve having a thicker center portion as compared to upper and lower ends 52, 54. This thicker portion is disposed between upper and lower retainer rings 56, 58 and, as shown with reference to sealing device 60, has an outer diameter that is equal to the outer diameter of both upper and lower retainer rings 56, 58 when in the run-in position. It is to be understood, however, that sealing element 51 may have an outer diameter that is less than the outer diameter of one or both of upper or lower retainer rings 56, 58 when in its run-in position or it may have an outer diameter that is greater than the outer diameter of one or both upper or lower retainer rings 56, 58 when in its run-in position.

Further, in the embodiment shown in FIG. 1, upper and lower ends 52, 54 are shown protruding above and below upper and lower retainer rings 56, 58; however, upper and lower ends 52, 54 are not required to protrude above and below upper and lower retainer rings in this manner.

Sealing element 51 is maintained against outer wall surface 39 of expandable casing 30 using any device or method known to persons of ordinary skill in the art. For example, sealing element 51 may be chemically bonded to outer wall surface 39. Alternatively, sealing element 51 can be maintained solely by upper and lower retainer rings 56, 58.

Upper retainer rings 56 and lower retainer rings 58 are expandable members disposed around the outer diameter of sealing element 51 and, thus, can maintain or assist in maintaining sealing element 51 along outer wall surface 39. In this embodiment both upper retainer ring 56 and lower retainer ring 58 have a relatively flat vertical cross-section parallel or substantially parallel to the axial length of the expandable casing 30. As additionally shown in FIG. 1, both upper and lower retainer rings 56, 58 have an axial length greater than their width so that the inner diameter surface area of both upper and lower retainer rings 56, 58 are in contact with sealing element 51 to facilitate extrusion of sealing element 51 during expansion of expandable casing 30.

Although the shape of upper and lower retainer rings 56, 58 are discussed with reference to FIG. 1, it is to be understood that upper and lower retainer rings 56, 58 may have any shape desired or necessary to provide the necessary force against sealing element 51 during expansion of expandable casing 30 so that sealing element 51 is extruded to seal against inner wall surface 22 of well 20.

Further, upper and lower retainer rings 56, 58 may be formed from any material known to persons of ordinary skill in the art. For example, one or both of upper and lower retainer rings 56, 58 may be formed from stiffer elastomers, polymers, or metals such as steel.

After expandable casing 30 is properly located within well 20, a cone (not shown) or other expanding device is run through bore 36 of expandable casing 30. As the cone travels downward, i.e., downhole, expandable casing 30 is forced radially outward from axis 40. In so doing, run-in diameter 42 is radially expanded to transition diameter 46 and ultimately to set diameter 44. As a result of the radial expansion of expandable casing 30, sealing element 51 is forced into upper and lower retainer rings 56, 58. Although upper and lower retainer rings 56, 58 are radially expandable, they are formed from a material that is stronger, i.e., more resistance to expansion, compared to the material used to form sealing element 51. As a result, as expandable casing 30 is expanded, sealing material 51 is compressed, deformed, or extruded in between outer wall surface 39 of expandable casing and the inner wall surfaces of upper and lower retainer rings 56, 58 defined by the inner diameters of upper and lower retainer rings 56, 58. Due to the compression of sealing element 51 between outer wall surface 39 of expandable casing 30 and the inner wall surfaces of upper and lower retainer rings 56, 58, the center portion of sealing element 51 is extruded outwardly in between upper and lower retainer rings 56, 58; upper end 52 of sealing element 51 is extruded outwardly above upper retainer ring 56; and lower end 54 of sealing element 51 is extruded outwardly below lower retainer ring 58 until all three portions of sealing element 51 form a seal against inner wall surface 22 of well 20. The distance between the outer diameter of upper and lower retainer rings 56, 58 and inner wall surface 22 of well 20 is referred to as the extrusion gap.

Figure 2:
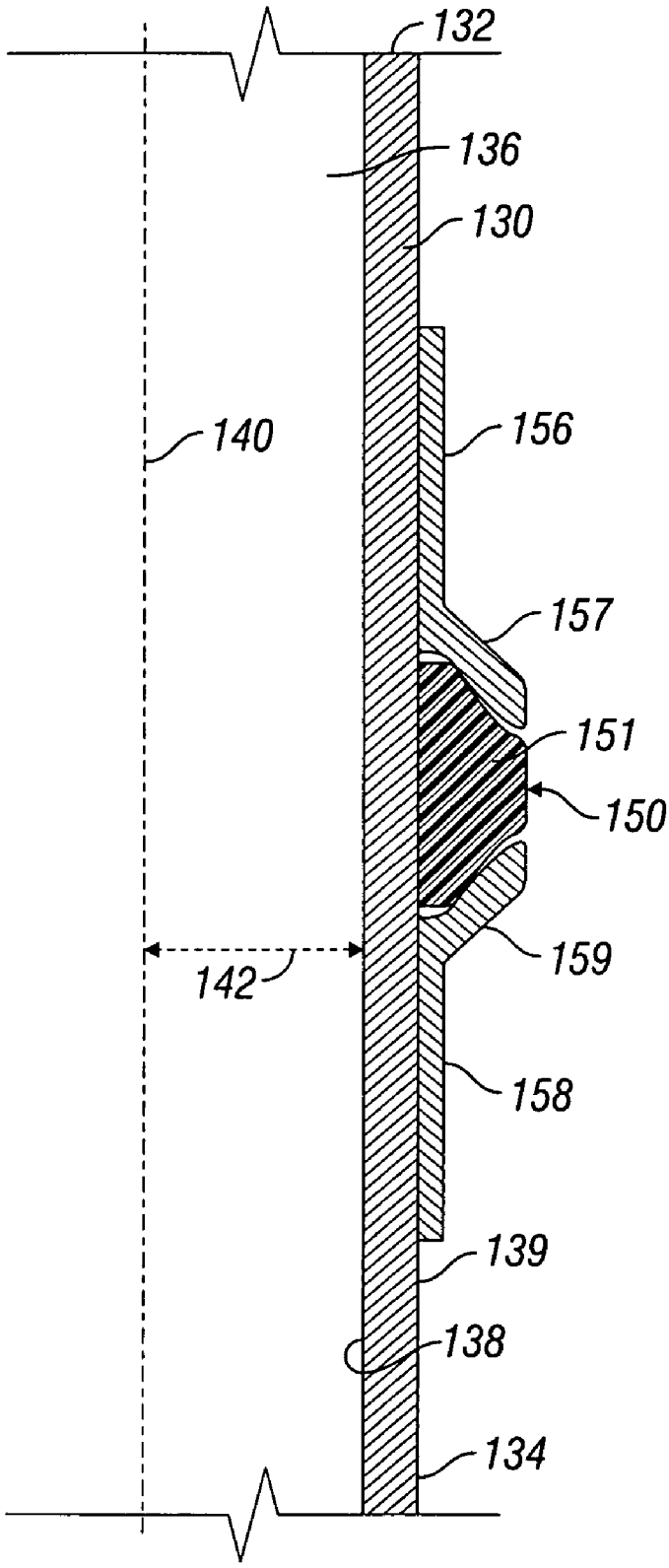
FIG. 2 is a cross-sectional view of another specific embodiment of an expandable casing having a sealing device, FIG. 2 showing the expandable casing in its run-in position.
Figure 3:
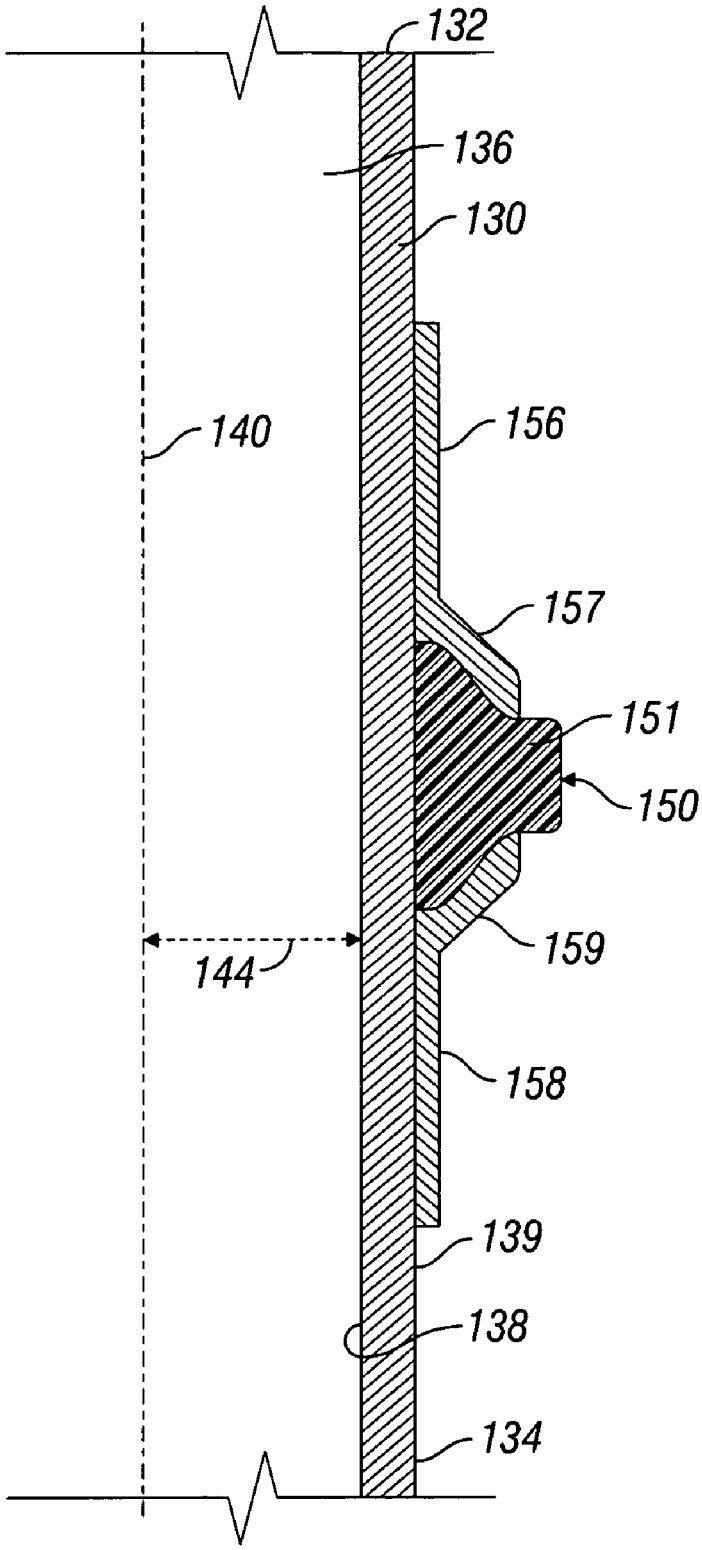
FIG. 3 is a cross-sectional view of the expandable casing shown in FIG. 2 shown in its expanded or set position.

Referring now to FIGS. 2-3, in another embodiment, expandable casing 130 has upper end 132, lower end 134, bore 136 defined by inner wall surface 138, outer wall surface 139, and axis 140. Expandable casing 30 includes run-in diameter defined by run-in radius 142 (FIG. 2) and set diameter defined by set radius 144 (FIG. 3). Run-in radius 142 and, thus, the run-in diameter, is less than set radius 144 and, thus, the set diameter. Expandable casing 130 is radially expanded using a cone (not shown) or other device used to expand expandable casing 130 from the run-in diameter defined by run-in radius 142 to the set diameter defined by set radius 144 in the same manner as the embodiment discussed above with respect to FIG. 1.

As illustrated in FIG. 2, expandable casing 130 is in the run-in position. Disposed on outer wall surface 139 of expandable casing 130 is sealing device 150. Although only a single sealing device 150 is shown, it is to be understood that more than one sealing device may be disposed on outer wall surface 139 of expandable casing 130.

Sealing device 150 includes annular sealing element 151, upper retainer ring 156 and lower retainer ring 158. Annular sealing element 151 is a deformable element formed from a deformable material such as those discussed above with respect to sealing element 51. In this embodiment, sealing element 151 has a trapezoid section such that the inner surface of sealing element 151 has a longer axial length along outer wall surface 139 than the axial length of the outer surface defined by the outer diameter of sealing element 151.

Upper retainer ring 156 has upper flare portion 157 and lower retainer ring 158 has lower flare portion 159 thereby forming a cavity between upper retainer ring 156 and lower retainer ring 158 with a gap between the lowermost end of upper retainer ring 156 and the uppermost end of lower retainer ring 158. Sealing element 151 is disposed within the cavity. In one specific embodiment, sealing element 151 is maintained along outer wall surface 139 through any device or method known to persons of ordinary skill in the art, such as through chemical bonding or by upper and lower retainer rings 156, 158.

As with the embodiment shown in FIG. 1, upper and lower retainer rings 156, 158 may be formed from any material known to persons of ordinary skill in the art. For example, one or both of upper and lower retainer rings 156, 158 may be formed from stiffer elastomers, polymers, or metals such as steel.

Upper flare portion 157 and lower flare portion 159 may have any shape or angle relative to the remaining vertical portions of upper and lower flare portions. For example, upper and lower flare portions 157, 159 may be at an angle in a range greater than 0 degrees and less than 90 degrees relative to the vertical portions of upper and lower flare portions 157, 159. Additionally, the angle at which upper flare portion 157 intersects the remaining portion of upper retainer ring may be different from the angle at which lower flare portion 159 intersects the remaining portion of lower retainer ring 158. In one specific embodiment, both of these angles are within the range from 30 degrees to 60 degrees so that sufficient inward force can be applied to sealing element 151 during expansion of expandable casing 130 to extrude sealing element 151 through the gap between the lowermost and uppermost ends of upper retainer ring 156 and lower retainer ring 158, respectively. In the embodiment shown in FIGS. 2-3, upper and lower flare portions 157, 159 are reciprocally shaped to receive sealing element 151 so that a portion of both upper and lower flare portions 157, 159 contact sealing element 151 during run-in.

Upper and lower retainer rings 156, 158 can be secured to outer wall surface 139 through any device or method known to persons of ordinary skill in the art. For example, upper and lower retainer rings 156, 158 may be welded or epoxied to outer wall surface 139. Alternatively, upper and lower retainer rings 156, 158 may be secured or formed integral with an expandable mandrel (not shown) that is then secured such as through threads to an expandable casing string.

As shown in FIG. 2, sealing element 151 of sealing device 150 is in its run-in position such that it does not protrude outwardly from outer wall surface 139 past upper or lower retainer rings 156, 158. It is to be understood that although sealing element 151 is shown as having an outer diameter equal to the outer diameters of upper and lower retainer rings 156, 158, sealing element 151 may have either an outer diameter that is less than the outer diameter of one or both of upper or lower retainer rings 156, 158 when in its run-in position, or an outer diameter that is greater than the outer diameter of one or both of upper or lower retainer rings 156, 158 when in its run-in position.

After expandable casing 130 is properly located within well (not shown), a cone (not shown) or other expanding device is run through bore 136 of expandable casing 130. As the cone travels downward, i.e., downhole, expandable casing 130 is forced radially outward from axis 140. In so doing, the run-in diameter illustrated by run-in radius 142 is radially expanded to a transition diameter (not shown) and ultimately to set diameter illustrated by set radius 144 (FIG. 3). As a result of the radial expansion of expandable casing 130, sealing element 151 is forced into upper and lower flare portions 157, 159 of upper and lower retainer rings 156, 158. As with upper and lower retainer rings 56, 58, upper and lower retainer rings 156, 158 are radially expandable; however, they are formed from a material that is stronger, i.e., has more resistance to expansion, compared to the material used to form sealing element 151. As a result, as expandable casing 130 is expanded, upper and lower flare portions 157, 159 bend inward toward axis 140 as expandable casing 130 expands and, thus, compress, deform, or extrude sealing element 151 within the cavity in between outer wall surface 139 of expandable casing 130 and upper and lower flare portions 157, 159. In other words, upper flare portion 157 and lower flare portion 159 become more straightened in line with the remaining portions of upper retainer ring 156 and lower retainer ring 158, respectively, so that sealing element 151 is forced radially outward.

Due to the compression of sealing element 151 between outer wall surface 139 of expandable casing 130 and the upper and lower flare portions 157, 159, sealing element 151 is extruded outwardly from the cavity through the gap located between the lowermost end of upper retainer ring 156 and the upper most end of lower retainer ring 158 until sealing element 151 forms a seal against the inner wall surface of the well. This distance between the outermost diameters of upper and lower retainer rings 156, 158 and the inner wall surface of the well is referred to as the extrusion gap.

It is to be understood that the invention is not limited to the exact details of construction, operation, exact materials, or embodiments shown and described, as modifications and equivalents will be apparent to one skilled in the art. For example, the sealing devices may be disposed on an expandable mandrel that is placed within an expandable casing string. Additionally, the expandable casing may have one or more sealing devices 50 or 60 together with one or more sealing devices 150. Moreover, a spacer may be disposed in between outer wall surface 39 of expandable casing 30 and the inner diameter of sealing element 151 to assist in extrusion of sealing element 151 during expansion of expandable casing 130. Further, the inner diameter of upper retainer ring 56 is not required to be equal to the inner diameter of lower retainer ring 58. Likewise, the shape of upper flare portion 157 is not required to be the same shape as lower flare portion 159. Additionally, the expandable casing 30, 130 may be disposed in a cased wellbore as opposed to an open-hole wellbore. Thus, the term "wellbore" as used herein includes a cased wellbore as well as an opened-hole wellbore. Accordingly, the invention is therefore to be limited only by the scope of the appended claims.

What is claimed is:

1. A sealing device for a radially expandable casing, the sealing device comprising:
- a first retainer ring comprising a first end portion and a second end;
- a second retainer ring;
- a gap disposed between the first retainer ring and the second retainer ring; and
- an extrudable sealing element disposed between the first retainer ring and the second retainer ring and in fluid communication with the gap,
  - the extrudable sealing element being extrudable through the gap when the expandable casing is radially expanded from a first position to a second position,
  - wherein during expansion of the expandable casing toward the second position, the second end portion of the first retainer ring is moved with respect to an outer wall surface of the expandable casing toward an axis of the expandable casing.

2. The sealing device of claim 1, wherein the second retainer ring comprising a second retainer ring first end portion and a second retainer ring second end portion, and
- wherein during expansion of the expandable casing toward the second position, the second retainer ring second end portion of the second retainer ring is moved with respect to an outer wall surface of the expandable casing toward the axis of the expandable casing.

3. A sealing device for a radially expandable casing, the sealing device comprising:
- a first retainer ring comprising a first end portion disposed substantially parallel to an axis of the expandable casing and a second end portion disposed at a first initial angle relative to the first end portion, the first initial angle being less than 90 degrees and more than 0 degrees;
- a second retainer ring;
- a gap disposed between the first retainer ring and the second retainer ring; and
- an extrudable sealing element disposed between the first retainer ring and the second retainer ring and in fluid communication with the gap,
  - the extrudable sealing element being extrudable through the gap when the expandable casing is radially expanded from a first position to a second position, wherein during expansion of the expandable casing toward the second position, the first initial angle is reduced.

4. The sealing device of claim 3, wherein the second retainer ring comprises a second retainer ring first end portion disposed substantially parallel to the axis of the expandable casing and a second retainer ring second end portion disposed at a second initial angle relative to the second retainer ring first end portion, the second initial angle being less than 90 degrees and more than 0 degrees;

wherein during expansion of the expandable casing toward the second position, the second initial angle is reduced.

5. A sealing device for a radially expandable casing, the sealing device comprising:

a first retainer ring;

a second retainer ring;

a gap disposed between the first retainer ring and the second retainer ring; and an extrudable sealing element disposed between the first retainer ring and the second retainer ring and in fluid communication with the gap, the extrudable sealing element being extrudable through the gap when the expandable casing is radially expanded from a run-in casing radius to a set casing radius, the set casing radius being greater than the run-in casing radius and the difference between the set casing radius and the run-in casing radius defining a casing radius differential, wherein during expansion of the expandable casing, a portion of the first retainer ring is radially expanded outward from a first run-in ring radius, as measured from an axis of the expandable casing to the portion of the first retainer ring, to a first set ring radius, as measured from the axis of the expandable casing to the portion of the first retainer ring, the first set ring radius being greater than the first run-in ring radius, and the difference between the first set ring radius and the first run-in ring radius defining a first ring radius differential, and wherein the casing radius differential is greater than the first ring radius differential.

6. The sealing device of claim 5, wherein during expansion of the expandable casing, a portion of the second retainer ring is radially expanded outward from a second run-in ring radius, as measured from the axis of the expandable casing to the portion of the second retainer ring, to a second set ring radius, as measured from the axis of the expandable casing to the portion of the second retainer ring, the second set ring radius being greater than the second run-in ring radius, and the difference between the second set ring radius and the second run-in ring radius defining a second ring radius differential, and wherein the casing radius differential is greater than the second ring radius differential.

* * * * *